US008567025B2

(12) United States Patent
Heffe

(10) Patent No.: US 8,567,025 B2
(45) Date of Patent: Oct. 29, 2013

(54) DEEP ROLLING ROLLER OF A DEEP ROLLING MACHINE ARRANGED DETACHABLY ON A HOUSING

(75) Inventor: Roland Heffe, Korschenbroich (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 129 days.

(21) Appl. No.: 13/257,616

(22) PCT Filed: Mar. 24, 2010

(86) PCT No.: PCT/DE2010/000362

§ 371 (c)(1),
(2), (4) Date: Dec. 29, 2011

(87) PCT Pub. No.: WO2010/108489

PCT Pub. Date: Sep. 30, 2010

(65) Prior Publication Data

US 2012/0090141 A1 Apr. 19, 2012

(30) Foreign Application Priority Data

Mar. 25, 2009 (DE) ..... 20 2009 004 172 U
Sep. 25, 2009 (DE) ..... 20 2009 012 976 U

(51) Int. Cl.
*B21K 1/08* (2006.01)
*B24B 39/00* (2006.01)

(52) U.S. Cl.
USPC ..... 29/6.01; 29/90.01

(58) Field of Classification Search
USPC ..... 29/90.01, 90.5, 90.6, 6.01, 895.2, 29/895.22, 895.23, 888.08; 492/1, 16, 47
See application file for complete search history.

(56) References Cited

U.S. PATENT DOCUMENTS

| | | | | |
|---|---|---|---|---|
| 2,053,009 | A | 9/1936 | Schmidt | |
| 2,977,669 | A | 4/1961 | Chambers | |
| 3,566,653 | A * | 3/1971 | Unrath | 72/96 |
| 3,878,702 | A | 4/1975 | Brouard Madariaga et al. | |
| 5,099,558 | A | 3/1992 | Wilson | |

FOREIGN PATENT DOCUMENTS

| | | |
|---|---|---|
| DE | 843822 C | 7/1952 |
| DE | 2307128 A1 | 6/1974 |

OTHER PUBLICATIONS

International Search Report for PCT/DE2010/000362, ISA/EP, Rijswijk, NL, mailedSep. 9, 2010.

* cited by examiner

*Primary Examiner* — David Bryant
*Assistant Examiner* — Matthew P Travers
(74) *Attorney, Agent, or Firm* — Harness, Dickey & Pierce, P.L.C.

(57) ABSTRACT

A work roller (1) is detachably attached to a housing (2). The work roller (1) is positioned on a pin between a pin head (7) and a lid (20) allowing it to rotate freely, while the housing (2) provides a recess (6) for the deep rolling tool (1), a receptacle (10) for the pin head (7) and a receptacle (19) for the lid (20). The receptacle (10) for the pin head (7) is shaped like a subarea (11, 14) of a truncated cone and has a concentric collar (23) around the rotational axis (24) of the work roller (1) while the receptacle (19) for the lid (20) is shaped like a subarea (16, 17) of a circular cylinder.

7 Claims, 3 Drawing Sheets

Fig. 6
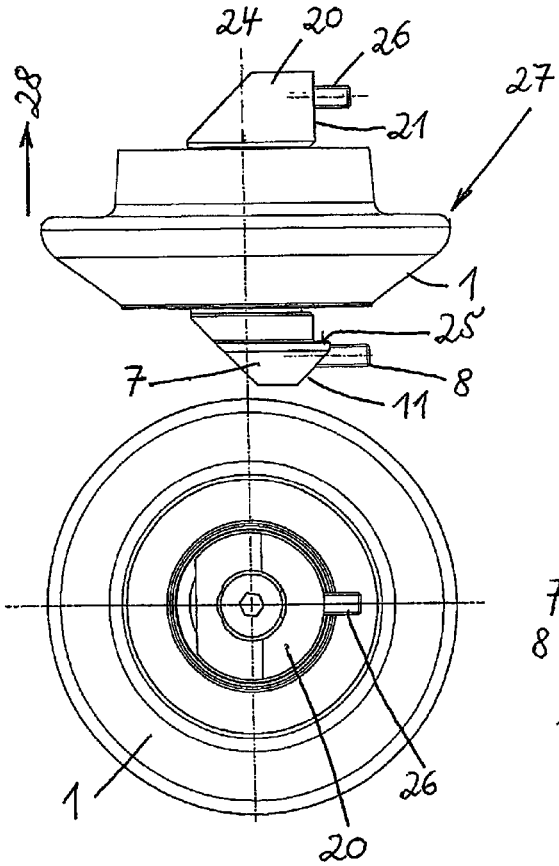
Fig 4
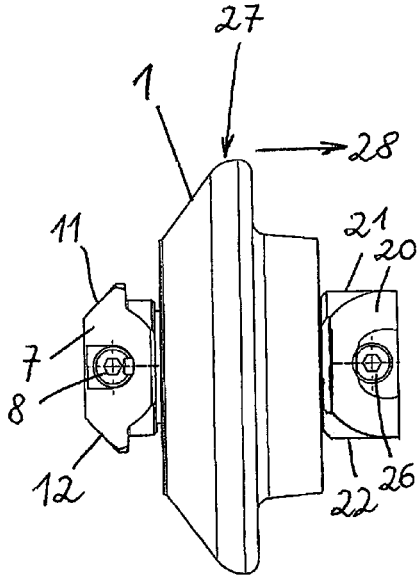
Fig. 5

DEEP ROLLING ROLLER OF A DEEP ROLLING MACHINE ARRANGED DETACHABLY ON A HOUSING

CROSS-REFERENCE TO RELATED APPLICATIONS

This application is a 371 U.S. National Stage of International Application No. PCT/DE2010/000362, filed Mar. 24, 2010. This application claims the benefit of German Patent Applications No. DE 20 2009 004 172.7, filed Mar. 25, 2009, and DE 20 2009 012 976.4, filed Sep. 25, 2009. The entire disclosures of the above applications are incorporated herein by reference.

FIELD OF THE INVENTION

The invention relates to a work roller of a crankshaft deep rolling tool detachably attached to a housing, which is positioned on a pin between a pin head and a lid in a way which allows it to rotate freely, while the housing provides a recess for the deep rolling tool, a receptacle for the pin head and a receptacle for the lid.

DESCRIPTION OF RELATED ART

A "device for burnishing cylindrical workpieces like shaft parts" is known from the German patent specification DE 843 822. At the time the named patent was developed, deep rolling was called "burnishing". On devices familiar since then, each work roller is positioned on both sides if the workpiece leaves enough space for storing the work rollers on either side of the surface to be stamped. The present invention concerns this type of work-roller storage.

SUMMARY OF THE INVENTION

The basis of the invention is the task of arranging the storage of a work roller in such a way that the work roller, alongside applying large radial forces, namely for the deep rolling process, is also capable of absorbing considerable feed-direction forces which occur during the deep rolling process. In doing so, the fixing for the work roller should be as simple, as free of play and as cheap as possible. In addition, damaged work rollers as well as work rollers with a different design should be able to be changed quickly.

A suggested solution to this problem is a receptacle for the pin head, shaped like a subarea of a truncated cone, which has a collar concentrically placed around the work roller's rotation axis. The receptacle for the lid is shaped like a subarea of a circular cylinder.

In accordance with a beneficial design shape, the receptacle for the pin head can also be shaped like a subarea of a circular cylinder while the receptacle for the lid is shaped like a subarea of a truncated cone and has a collar concentrically placed around the work roller's rotation axis. Hexagon head cap screws are intended for fixing both the pin head and the lid onto the housing. A sufficiently accurate and secure fixing is thus achieved. This type of fixing also meets the demand that the work roller should be able to be changed quickly.

BRIEF DESCRIPTION OF THE DRAWINGS

The invention is described in detail below using a design example. The following are not shown to scale.

DETAILED DESCRIPTION

Figure 1:
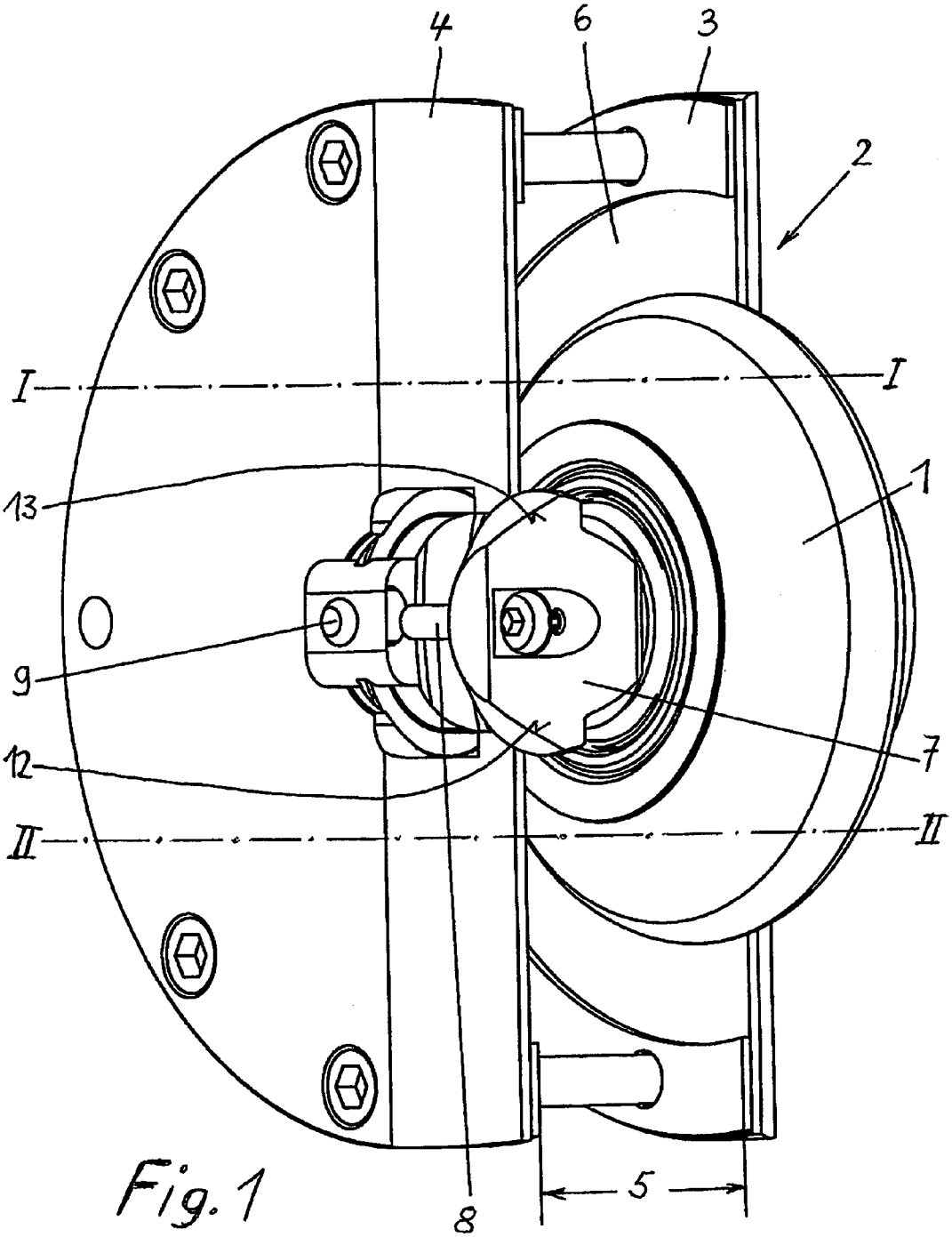
FIG. 1, a work roller's receptacle in a housing
FIG. 2, a receptacle design for the pin head FIG. 3, a receptacle design for the lid
FIG. 4, the front view of a work roller
FIG. 5, the side view of the work roller from FIG. 4
FIG. 6, the plan view of the work roller from FIG. 4

The work roller 1 in FIG. 1 is positioned in a housing 2 in a way which allows it to rotate freely. The housing 2 consists of both housing covers 3 and 4 which run parallel to each other at a mutual distance 5. The distance 5 between the housing covers 3 and 4 provides space for the receptacle 6 of the work roller 1 in the housing 2. In FIG. 1 the pin head 7 of a pin (not shown), on which the worker roller 1 is positioned in a way which allows it to rotate freely, is shown. The pin head 7 should be fixed using a hexagon head cap screw 8 which is inserted into a tap hole 9 of the lid 4.

Figure 2:
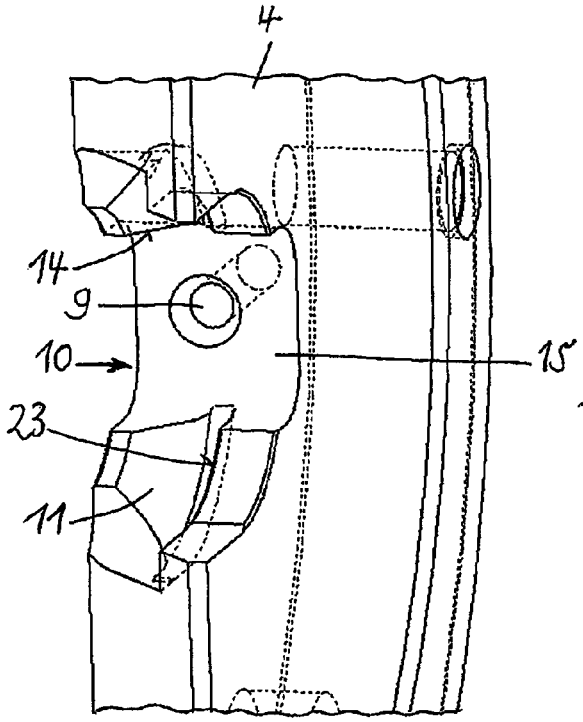

FIG. 2 shows a perspective display of an enlarged section of the receptacle 10, which is intended for fixing the pin head 7, in the lid 4. A truncated-cone-shaped subarea 11, on which the truncated-cone-shaped subarea 12 of the pin head 7 reaches the system, can firstly be identified. The truncated-cone-shaped subarea 13 of the pin head 7 reaches the system on a corresponding truncated-cone-shaped subarea 14 of the housing cover 4. Between the truncated-cone-shaped subareas 11 and 14 of the receptacle 10, there is a recess 15, into the centre of which the tap hole 9 leads, which is intended for fixing the pin head 7. FIG. 2 displays the section of the housing cover 4 which is located between lines I-I and II-II in FIG. 1.

Figure 3:
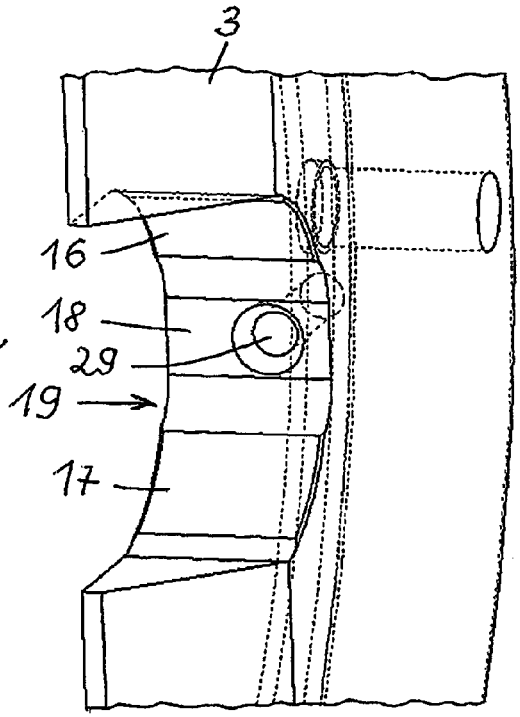

FIG. 3 displays a similar section from the housing cover 3 of the housing 2. Here, there are two cylinder-shaped subareas 16 and 17 which represent parts of a circular cylinder. A recess 18 similar to the recess 15 in FIG. 2 is located between the cylinder-shaped subareas 16 and 17. Just as receptacle 10 is intended for placing the pin head 7 in the housing cover 4, receptacle 19 is intended for placing the lid 20 (FIGS. 5 and 6) in the housing cover 3. In this case, there is also a tap hole 29 for fixing the hexagon head cap screw 8 onto the housing cover 3. Circular-cylinder-shaped subareas 21 and 22 of the lid 20 reach the system on the cylinder-shaped subareas 16 and 17 of the housing cover 3.

The housing cover 4 also has another collar 23 which runs concentrically around the rotation axis 24 of the work roller 1. When fitted, the collar area 25 of the pin head 7 reaches the system on the collar 23 of the housing cover 4.

The hexagon head cap screw 26 is intended for fixing the lid 20 onto the housing cover 3. The shape of the cross-section 27 of the displayed work roller 1 is specified through a special application which is irrelevant in relation to the present invention. Instead of cross-sectional shape 27, the work roller 1 can also have any other cross-sectional shape, in particular the shape of a torus. In the present case, the preferred feed direction of the work roller 1 is denoted by the arrow 28.

NUMBER INDEX

1 Work roller
2 Housing
3 Housing cover
4 Housing cover
5 Distance
6 Receptacle
7 Pin head
8 Hexagon head cap screw
9 Tap hole
10 Receptacle

11 Truncated-cone-shaped subarea
12 Truncated-cone-shaped subarea
13 Truncated-cone-shaped subarea
14 Truncated-cone-shaped subarea
15 Recess
16 Cylinder-shaped subarea
17 Cylinder-shaped subarea
18 Recess
19 Receptacle
20 Lid
21 Circular-cylinder-shaped subarea
22 Circular-cylinder-shaped subarea
23 Collar
24 Rotation axis
25 Collar area
26 Hexagon head cap screw
27 Cross-sectional shape
28 Feed
29 Tap hole

The invention claimed is:

1. A work roller of a crankshaft deep rolling tool detachably attached to a housing, which is positioned on a pin between a pin head and a lid in a way which allows it to rotate freely, while the housing provides a recess for the deep rolling tool, a receptacle for the pin head and a receptacle for the lid, wherein the receptacle for the pin head is shaped like a subarea of a truncated cone and has a collar concentrically placed around the rotation axis of the work roller while the receptacle for the lid is shaped like a subarea of a circular cylinder.

2. A work roller of a crankshaft deep rolling tool detachably attached to a housing according to claim 1, wherein the pin head is fixed to the housing with a hexagon head cap screw.

3. A work roller of a deep rolling tool detachably attached to a housing according to claim 1, wherein the lid is fixed to the housing with a hexagon head cap screw.

4. A work roller of a crankshaft deep rolling tool detachably attached to a housing, which is positioned on a pin between a pin head and a lid in a way which allows it to rotate freely, while the housing provides a recess for the deep rolling tool, a receptacle for the pin head and a receptacle for the lid, wherein:

the receptacle for the pin head is shaped like a subarea of a circular cylinder while the receptacle for the lid is shaped like a subarea of a truncated cone and has a collar concentrically placed around the rotation axis of the work roller.

5. A work roller of a crankshaft deep rolling tool detachably attached to a housing according to claim 2, wherein the pin head is fixed to the housing with a hexagon head cap screw.

6. A work roller of a deep rolling tool detachably attached to a housing according to claim 4, wherein the lid is fixed to the housing with a hexagon head cap screw.

7. A crankshaft deep rolling tool comprising:

a work roller detachably attached to a housing, the work roller rotatably mounted about an axis of rotation on a pin between a pin head and a lid;

the housing comprising first and second housing covers for receiving the deep rolling tool;

the first cover comprising a first receptacle for locating the pin head comprising two conically-shaped surfaces having a recess therebetween, and a collar located concentrically to the axis of rotation;

the second cover comprising a second receptacle for locating the lid comprising two cylindrically-shaped surfaces having a recess therebetween.

* * * * *